US007600856B2

(12) United States Patent
Lebens et al.

(10) Patent No.: US 7,600,856 B2
(45) Date of Patent: Oct. 13, 2009

(54) LIQUID EJECTOR HAVING IMPROVED CHAMBER WALLS

(75) Inventors: John A. Lebens, Rush, NY (US); Lingadahalli G. Shantharama, Penfield, NY (US)

(73) Assignee: Eastman Kodak Company, Rochester, NY (US)

( * ) Notice: Subject to any disclaimer, the term of this patent is extended or adjusted under 35 U.S.C. 154(b) by 485 days.

(21) Appl. No.: 11/609,365

(22) Filed: Dec. 12, 2006

(65) Prior Publication Data

US 2008/0136867 A1 Jun. 12, 2008

(51) Int. Cl.
*B41J 2/05* (2006.01)

(52) U.S. Cl. ..... 347/56; 347/63; 347/47

(58) Field of Classification Search ..... 347/20, 347/44, 47, 56, 61–65, 67, 54
See application file for complete search history.

(56) References Cited

U.S. PATENT DOCUMENTS

| | | | | |
|---|---|---|---|---|
| 5,478,606 | A | 12/1995 | Ohkuma et al. | |
| 6,022,482 | A | 2/2000 | Chen et al. | |
| 6,234,608 | B1 | 5/2001 | Genovese et al. | |
| 6,331,258 | B1 | 12/2001 | Silverbrook | |
| 6,331,259 | B1 | 12/2001 | Ozaki et al. | |
| 6,474,795 | B1 | 11/2002 | Lebens et al. | |
| 6,482,574 | B1 | 11/2002 | Ramaswami et al. | |
| 6,555,480 | B2 | 4/2003 | Milligan et al. | |
| 6,561,627 | B2 | 5/2003 | Jarrold et al. | |
| 6,569,343 | B1 | 5/2003 | Suzuki et al. | |
| 6,644,786 | B1 | 11/2003 | Lebens | |
| 7,517,051 | B2 * | 4/2009 | Kim et al. | 347/47 |
| 2002/0044176 | A1 | 4/2002 | Yamaguchi et al. | |
| 2003/0025760 | A1 | 2/2003 | Imamura et al. | |
| 2005/0140727 | A1 | 6/2005 | Silverbrook | |

FOREIGN PATENT DOCUMENTS

| | | |
|---|---|---|
| EP | 0 904 939 | 3/1999 |
| EP | 1 366 906 | 12/2003 |

* cited by examiner

*Primary Examiner*—Juanita D Stephens
(74) *Attorney, Agent, or Firm*—William R. Zimmerli

(57) ABSTRACT

A liquid drop ejector includes a substrate and a plurality of liquid chambers. Portions of the substrate define a liquid supply. Each liquid chamber is positioned over the substrate and includes a nozzle plate and a chamber wall. The nozzle plate and the chamber wall include an inorganic material. The inorganic material of the nozzle plate and the chamber wall is contactable with liquid when liquid is present in each liquid chamber. A region of organic material is positioned over the substrate and located relative to the nozzle plate and the chamber wall such that the region of organic material is not contactable with liquid when liquid is present in each liquid chamber. The region of organic material is bounded by chamber walls of neighboring liquid chambers located on opposite sides of the liquid supply.

21 Claims, 15 Drawing Sheets

LIQUID EJECTOR HAVING IMPROVED CHAMBER WALLS

CROSS REFERENCE TO RELATED APPLICATIONS

Reference is made to commonly-assigned, U.S. patent application Ser. No. 11/609,375 filed concurrently herewith, entitled "LIQUID DROP EJECTOR HAVING IMPROVED LIQUID CHAMBER" in the name of John A. Lebens, the disclosure of which is incorporated herein by reference.

FIELD OF THE INVENTION

The present invention relates generally to monolithically formed liquid chambers and, more particularly, to liquid chambers used in ink jet devices and other liquid drop ejectors.

BACKGROUND OF THE INVENTION

Drop-on-demand (DOD) liquid emission devices have been known as ink printing devices in ink jet printing systems for many years. Early devices were based on piezoelectric actuators such as are disclosed by Kyser et al., in U.S. Pat. No. 3,946,398 and Stemme in U.S. Pat. No. 3,747,120. A currently popular form of ink jet printing, thermal ink jet (or "bubble jet"), uses electrically resistive heaters to generate vapor bubbles which cause drop emission, as is discussed by Hara, et al., in U.S. Pat. No. 4,296,421. Although the majority of the market for drop ejection devices is for the printing of inks, other markets are emerging such as ejection of polymers, conductive inks, or drug delivery.

In the past, print head fabrication involved the lamination of a nozzle plate onto the printhead. With this method alignment of the nozzle to the heater is difficult. Also the thickness of the nozzle plate is limited to above a certain thickness. Recently monolithic print heads have been developed through print head manufacturing processes which use photo imaging techniques. The components are constructed on a substrate by selectively adding and subtracting layers of various materials.

Ohkuma et al., in U.S. Pat. No. 5,478,606 discloses a method of monolithically fabricating an ink flow path and chamber with a nozzle plate. FIG. 1 shows the prior art device with a substrate 1 containing electrothermal elements 2, and an ink feed port 3. A photo-patternable resin 5 is formed on top of a dissoluble resin that defines the ink flow path including chamber 4. The dissoluble resin is subsequently removed to form the ink flow path and chamber.

In this method of forming ink flow path and chamber; the adjoining of the substrate 1 containing the electrothermal elements 2 and the ink flow path-forming member relies on the adhesion force of the resin 5 constituting the flow path-forming member. In the ink jet head, the flow path and chamber is constantly filled with ink in the normal state of use so that the periphery of the adjoining portion between the substrate and the flow path-forming member is in constant contact with the ink. Therefore, if the adjoining is achieved by the adhesion force only of the resin material, constituting the flow path-forming member, this adhesion can be deteriorated by the influence of the ink. The adhesion is especially poor in alkaline inks.

In addition, in most thermal ink jet heads the resin material adheres to in different regions an inorganic layer such as silicon nitride or silicon oxide. In other regions the resin is adhering to a tantalum layer used for cavitation protection.

Such tantalum layer has a lower adhesion force than the silicon nitride layer to the resinous material constituting the flow path-forming member. Therefore the resin may peel off of the tantalum layer. In order to prevent this from occurring, Yabe in U.S. Pat. No. 6,676,241 discloses forming an adhesion layer composed of polyetheramide resin between the substrate and the flow path-forming member. In this case improved adhesion can be maintained between silicon nitride or Tantalum layer and adjoining flow path member resin. However it is important that this adhesion layer be properly patterned so that no portion is in contact with the electrothermal element. Patterning of this layer includes extra steps in the fabrication, increasing expense and lowering yield. Also since the resin constituting the flow path member is still in contact with the ink it could swell causing stresses to develop between it and the adhesion layer again causing delamination of the flow path member.

Stout et al., in U.S. Pat. No. 6,739,519 also discloses a method of monolithically fabricating an ink flow path and chamber with a nozzle plate using photodefinable epoxy over a sacrificial resist layer or alternatively, with a double exposure of a photodefinable epoxy. The patent discusses the problem of continued adhesion between the epoxy nozzle plate and the substrate. Since the epoxy has a much larger thermal coefficient of expansion than the substrate thermal stresses can develop during firing of the heaters leading to delamination. The patent proposes the use of a primer layer between nozzle plate and substrate. However the epoxy interface is still in close proximity to the heater.

The nozzle plate formed from a resin material is gas permeable. Therefore the ink in the chamber below the nozzle plate is subjected to increased evaporation. As a result, properties of the ink, such as viscosity, in the chamber may change causing degradation of ejection characteristics. Also, air from the outside entering the chamber can cause bubble formation again degrading the ejection. Inoue et al., in U.S. Pat. No. 6,186,616 discloses adding a metal layer to the top of the nozzle plate resin to prevent air ingestion. However care must be taken that good adhesion is formed between the resin and metal layer. Also the metal must be compatible with the ink so that it does not corrode. Higher temperature deposited materials cannot be used due to the thermal restrictions of the resin material.

With the inside of a chamber formed with epoxy another issue is the wetting of the chamber walls with the ink. It is important that the inner chamber walls be wetting with the ink. Otherwise priming of the head will be difficult. Also, after a drop is ejected the chamber is depleted of ink and must completely refill before another drop can be fired. Non-wetting walls will impede the refill process. The contact angle of the epoxy wall can be lowered, for example, by exposure to oxygen plasma. However the surface returns to a non-wetting state over time. Also the oxygen plasma roughens the surface of the epoxy that again impedes refill.

It would therefore be advantageous to have an alternative choice for the inner chamber wall that is wetting with the ink, such as silicon oxide or silicon nitride. Such layers have excellent adhesion to the substrate layers used in the printhead. These layers are deposited at high temperatures and have other excellent properties for use in contact with the ink, such as material robustness, low thermal expansion, low moisture absorption and moisture permeability, Ramaswami et al., in U.S. Pat. No. 6,482,574 discloses an all-inorganic chamber by depositing a thick 5-20 μm layer of oxide, patterning and etching to form the chamber, filling the chamber with a sacrificial layer that is then planarized, depositing a nozzle plate, and removing the sacrificial material.

This procedure contains the difficult process of filling and planarizing the sacrificial material in the chamber region. Lack of planarization causes variation in chamber heights and loss of adhesion between chamber and nozzle plate. They also discuss the difficulty of depositing high quality dielectric material for the nozzle plate if the sacrificial material has temperature restrictions. It is also difficult to process such thick layers of oxide with long deposition and etch times. Such thick layers left on the substrate also have a tendency to crack due to stress build-up.

In commonly assigned U.S. Pat. No. 6,644,786 a chamber formation method is disclosed for a thermal actuator drop ejector. Non-photoimageable polyimide is patterned as the sacrificial layer allowing deposition of a high temperature inorganic structural layer such as silicon oxide or silicon nitride to form the chamber walls and nozzle plate. In this case only one deposition of the inorganic layer is needed to define both chamber walls and nozzle plate.

The above patent described formation of a chamber surrounding a single thermal actuator. No description is made of extending this process using thermal bubble jet heaters as drop ejectors. No description is made in extending the chamber formation to large arrays of ejectors with a corresponding large area ink feed port and how to provide structural support for this feed line. It is important for the structural design to be extensible. The chip containing the large array of drop ejectors also contains driver circuitry and logic on the chip that must be protected from the ink.

SUMMARY OF THE INVENTION

It is an object of the present invention to provide a liquid drop ejector comprising a plurality of liquid chambers where the chamber walls and nozzle plate are made from an inorganic material and formed using a sacrificial organic material.

It is also an object of the present invention to provide a region of organic material suspended of the liquid supply feed increasing the mechanical robustness of the liquid drop ejector.

It is also an object of the present invention to provide ribs in the liquid supply feed of the liquid drop ejector to further increase the mechanical robustness of the liquid drop ejector.

It is also an object of the present invention to provide gaps in the chamber walls to reduce the stress of the structure.

It is also an object of the present invention to provide an organic material layer over the circuitry of the liquid drop ejector for protection from the ink.

According to one aspect of the present invention, a liquid drop ejector includes a substrate and a plurality of liquid chambers. Portions of the substrate define a liquid supply. Each liquid chamber is positioned over the substrate and includes a nozzle plate and a chamber wall. The nozzle plate and the chamber wall include an inorganic material. The inorganic material of the nozzle plate and the chamber wall is contactable with liquid when liquid is present in each liquid chamber. A region of organic material is positioned over the substrate and located relative to the nozzle plate and the chamber wall such that the region of organic material is not contactable with liquid when liquid is present in each liquid chamber. The region of organic material is bounded by chamber walls of neighboring liquid chambers located on opposite sides of the liquid supply.

According to another aspect of the present invention, a liquid drop ejector includes a substrate and a plurality of liquid chambers. Portions of the substrate define a liquid supply. Each liquid chamber is positioned over the substrate and includes a nozzle plate and a chamber wall. The nozzle plate and the chamber wall include an inorganic material. The inorganic material of the nozzle plate and the chamber wall is contactable with liquid when liquid is present in each liquid chamber. A region of organic material is positioned over the substrate and located relative to the nozzle plate and the chamber wall such that the region of organic material is not contactable with liquid when liquid is present in each liquid chamber. No region of organic material is present between adjacent liquid chambers located on the same side of the liquid supply.

According to another aspect of the present invention, a liquid drop ejector includes a substrate and a liquid chamber for receiving a liquid. The liquid chamber is positioned over the substrate and includes a nozzle plate and a chamber wall. The nozzle plate and the chamber wall include an inorganic material. The inorganic material of the nozzle plate and the chamber wall is contactable with the liquid when the liquid is present in the chamber. The nozzle plate includes a top surface. The chamber wall includes two wall portions of inorganic material spaced apart from each other such that a gap exists between the two wall portions. The gap extends to the top surface of the nozzle plate. A region of organic material is positioned over the substrate and located relative to the nozzle plate and the chamber wall such that the region of organic material is not contactable with the liquid when the liquid is present in the chamber.

According to another aspect of the present invention, a method of manufacturing a liquid ejector includes providing a substrate; and forming a plurality of liquid chambers over the substrate by: providing an organic material over the substrate; patterning the organic material to create a location for the chamber wall of each liquid chamber; forming a nozzle plate and a chamber wall for each liquid chamber by depositing an inorganic material over the patterned organic material such that the inorganic material of the nozzle plate and the chamber wall is contactable with liquid when liquid is present in each liquid chamber; and removing a portion of the patterned organic material such that a region of organic material remains and is bounded by chamber walls of neighboring liquid chambers, wherein the region of organic material is not contactable with liquid when liquid is present in each liquid chamber.

BRIEF DESCRIPTION OF THE DRAWINGS

In the detailed description of the preferred embodiments of the invention presented below, reference is made to the accompanying drawings, in which.

DETAILED DESCRIPTION OF THE INVENTION

The present description will be directed in particular to elements forming part of, or cooperating more directly with, apparatus in accordance with the present invention. It is to be understood that elements not specifically shown or described may take various forms well known to those skilled in the art.

As described below, the present invention provides a method for forming a nozzle plate and chamber for a liquid drop ejector. The most familiar of such devices are used as printheads in ink jet printing systems. Many other applications are emerging which make use of devices similar to ink jet printheads, however which emit liquids other than inks, that need to be finely metered and deposited with high spatial precision. The terms ink jet and liquid drop ejector will be used herein interchangeably. The invention described below also provides for an improved chamber and nozzle plate for a liquid drop ejector.

Figure 1:
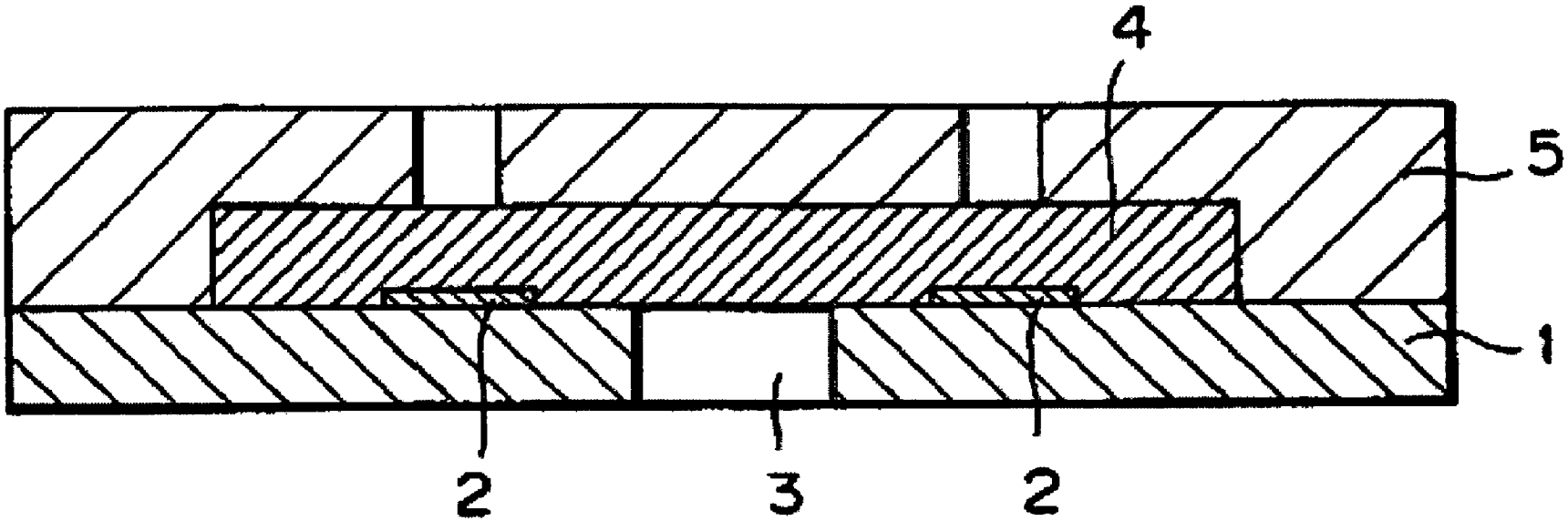
FIG. 1 (PRIOR ART)
FIG. 1 is a cross-sectional schematic view of an ink jet printhead according to the prior art.
Figure 2:
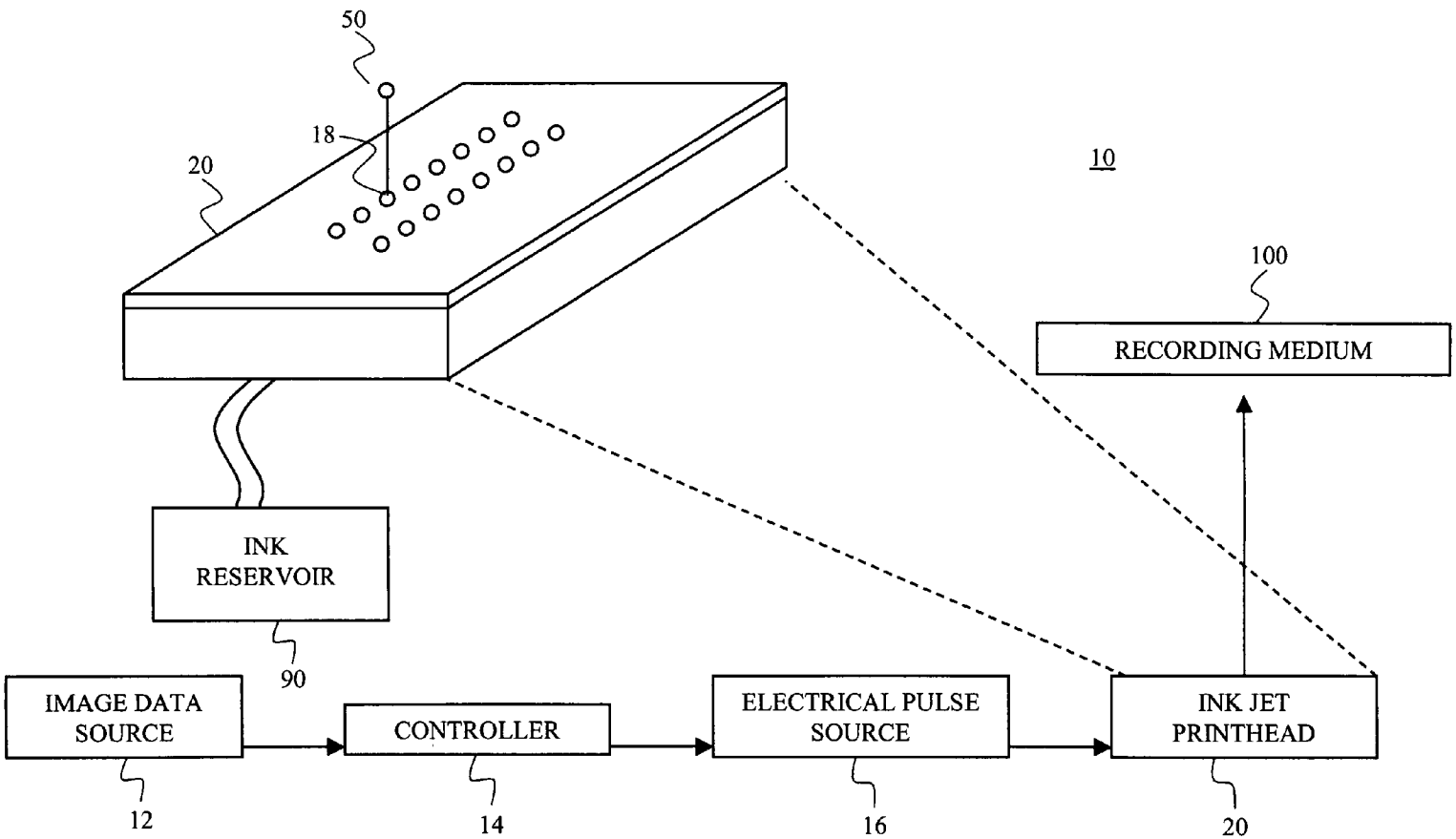
FIG. 2 is a schematic illustration of an ink jet printing system according to the present invention.

FIG. 2 is a schematic representation of an ink jet printing system 10, which incorporates a liquid drop ejector fabricated according to the present invention. The system includes an image data source 12 that provides signals that are received by controller 14 as commands to print drops. Controller 14 outputs signals to a source of electrical pulses 16. Electrical pulse source 16, in turn, generates an electrical voltage signal composed of electrical energy pulses which are applied to electrothermal heaters 2 within ink jet printhead 20. The pulse source 16 can be separate from the printhead. In the preferred embodiment the pulse source 16 is integrated into the printhead. The ink jet printhead 20 contains an array of nozzles 18 and associated electrothermal heaters 2. An ink reservoir 90 supplies ink to the printhead. An electrical energy pulse causes ejection of liquid through a nozzle 18, associated with the pulsed electrothermal heater, emitting an ink drop 50 that lands on recording medium 100.

Figure 3:
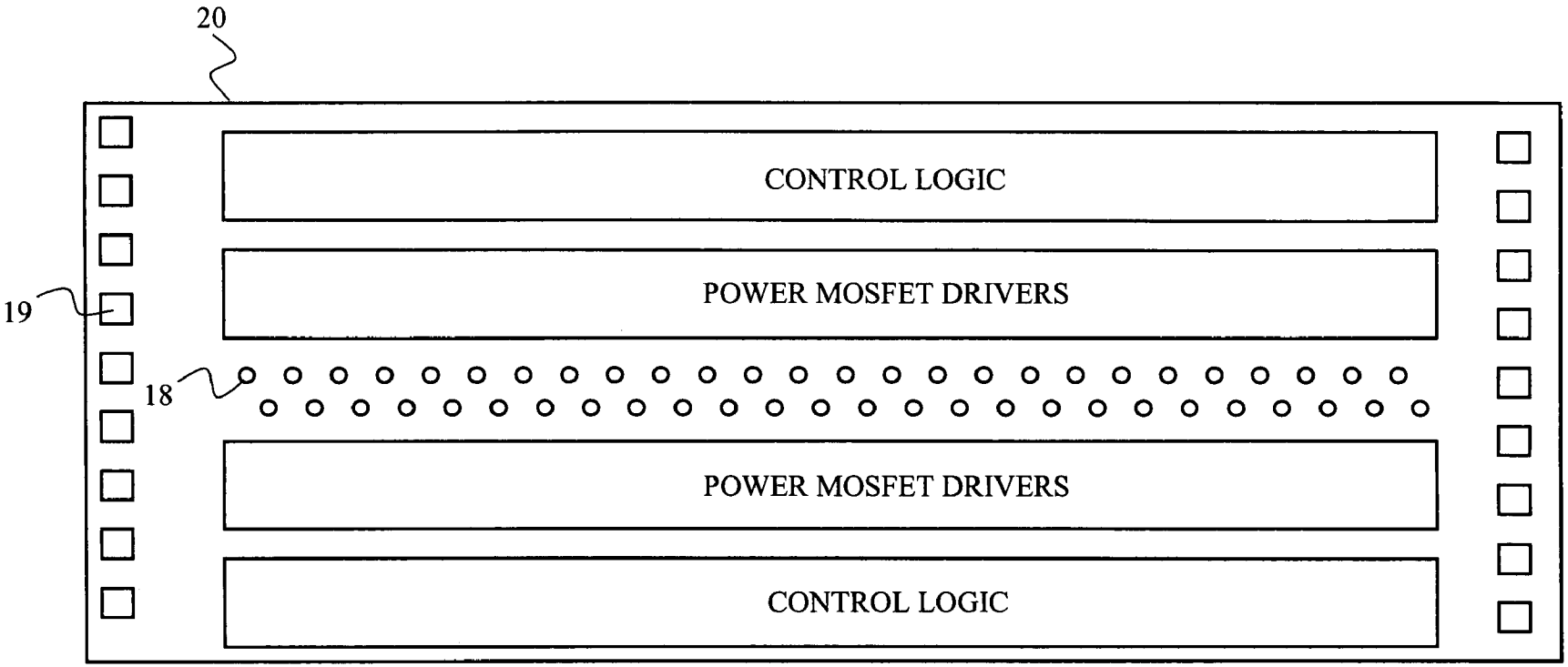
FIG. 3 illustrates a schematic top view of the ink jet printhead according to the present invention.

FIG. 3 illustrates a schematic top view of the ink jet printhead 20 of FIG. 2. In one embodiment the nozzles 18 are arranged in two rows. The nozzles in each row are offset to give the npi resolution of the head. In other embodiments the nozzle array in each row can be staggered or the nozzles can be patterned in a 2 dimensional array. The ink jet printhead of the present invention can comprise a large array of greater than 640 nozzles and can be extensible. Also contained within the printhead are power MOSFET drivers for each heater and CMOS control logic shown diagrammatically in FIG. 3. This circuitry must be protected from the ink over the lifetime of the ink jet printhead. Bondpads 19, for electrical communication with the printhead are located on the periphery of the printhead.

Figure 4:
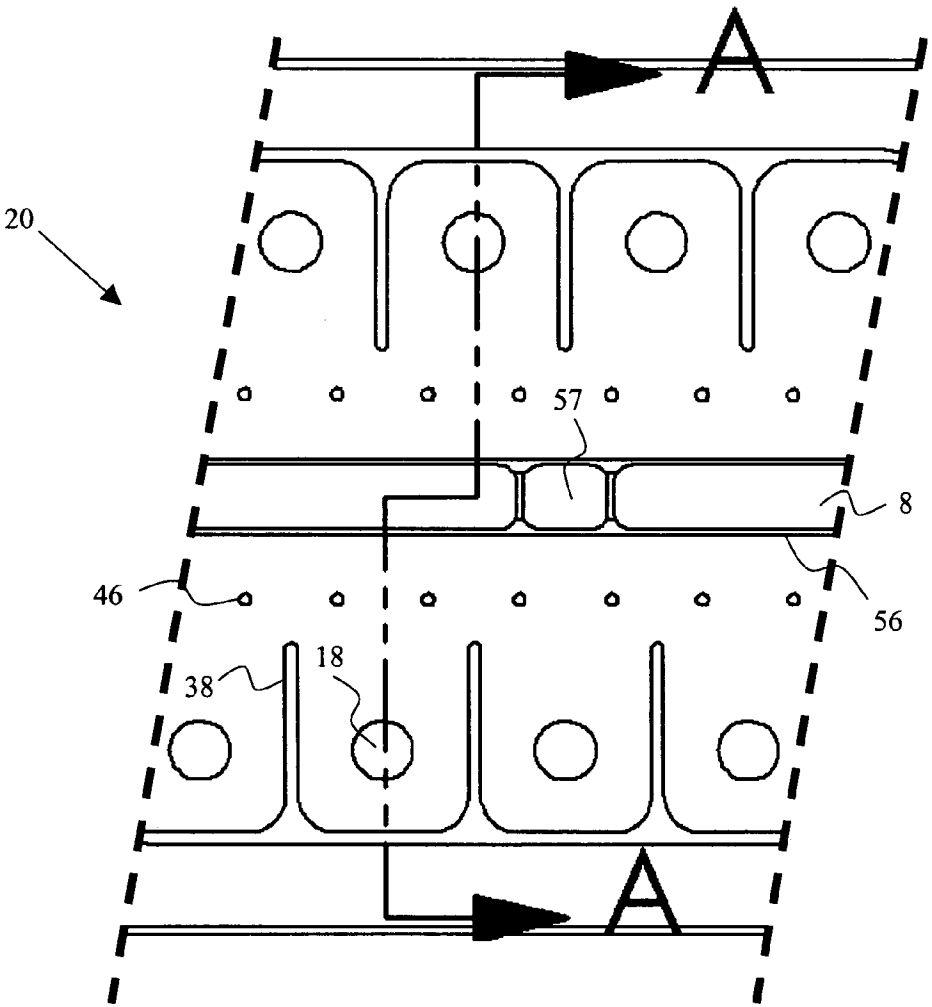
FIG. 4 shows a cutout top view of the ink jet printhead in the vicinity of the nozzle array according to the present invention.

FIG. 4 shows a top view of a section of the ink jet printhead 20 in the vicinity of the nozzle array. Each nozzle 18 is located above a corresponding electrothermal heater. Also seen from the top are chamber walls 38 that define the chamber for each heater/nozzle pair; a pillar array 46 that acts as a filter and also controls fluidic impedance during drop ejection and refill; and center support region walls 56 that define the center support region 8. In the center support region wall is a partition support structure 57 that is located on top of a rib structure located in the substrate.

Figure 5A:
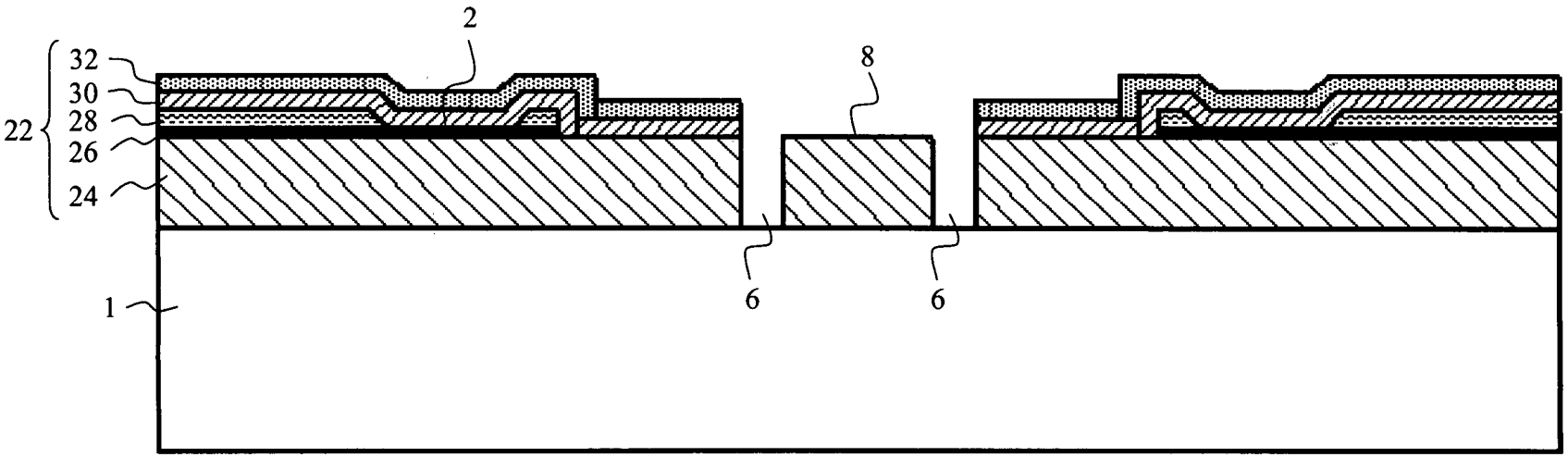
FIGS. 5A-5H show the process of forming an ink jet printhead with chamber and nozzle plate formed with an inorganic layer in cross-section of the embodiment shown in FIG. 4 taken through section A-A according to the present invention.

In FIGS. 5A-H the process of forming an ink jet printhead 20 with chamber and nozzle plate formed with an inorganic layer is illustrated in cross-section of the embodiment shown in FIG. 4 taken through section A-A, arranged to show the nozzle region for both rows. FIG. 5A illustrates the substrate prior to chamber formation in which the driver and control circuitry (not shown) has been formed on the substrate 1. Also shown is a thin film stack 22, including electrothermal heater 2. The substrate 1 is silicon in one embodiment. In other embodiments the substrate 1 is one of the following: polycrystalline silicon, silica, stainless steel, or polyimide.

A thermal barrier layer 24 may be formed of a variety of materials such as deposited silicon dioxide, field oxide, glass (BPSG) and oxynitride. This layer provides thermal and electrical isolation between the electrothermal element 2 and substrate 1. On top of the thermal barrier layer 24 is an electrically resistive heater layer 26. This electrically resistive heater layer is in this embodiment formed with a ternary Tantalum Silicon Nitride material.

An electrically conductive layer 28 is deposited on top of the electrically resistive heater layer 26. The electrically conductive layer 28 is formed from a metal typically used in MOS fabrication such as aluminum, or an aluminum alloy containing copper and/or silicon. The electrically conductive layer 28 is patterned and etched to form conductive traces which connects to the control circuitry fabricated on the ink jet printhead 20 and also defines the electrothermal heaters 2.

As shown in FIG. 5A, an insulating passivation layer 30 is next deposited. This insulating passivation layer 30 can be formed from silicon nitride, silicon oxide, and silicon carbide or any combination of these materials. On top of the insulating passivation layer 30 is deposited a protection layer 32. The protection layer 32 is formed from Tantalum, Tantalum Silicon Nitride or a combination of both materials. This layer protects the electrothermal heater from the ink. Two ink feed ports 6, one for each row of nozzles are etched through the thin film stack down to the substrate 1. Between the two ink feed ports is a chamber center support region 8. Some layers or the entire thin film stack is also used in defining the lower section of the center support region 8 between the ink feed ports.

Figure 5B:
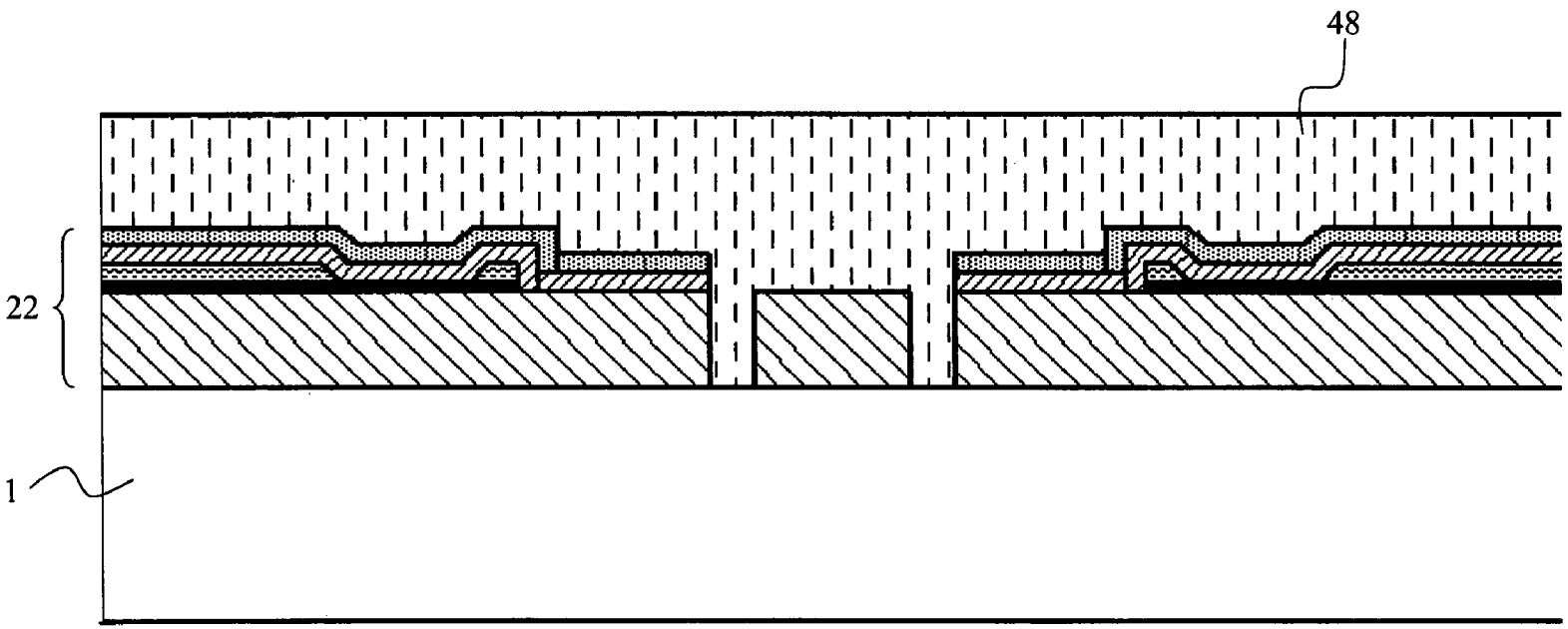

FIG. 5B illustrates one embodiment of the present invention in which an organic material 48 is coated or applied. In one embodiment the organic material 48 is a non-photoimageable polyimide. The polyimide selected is one with low thermal coefficient of expansion, good planarization and no added components such as photoactive compounds. One such polyimide is PI2611 from HD Microsystems. The organic material 48 defines the height of the chamber. The thickness of the organic material 48 after imidization bake is in the range 8-16 μm. In this embodiment the height is in the range 12-14 μm. The imidization bake is for one hour at a temperature between 300-400 C. In this embodiment a temperature is selected that is greater than or equal to any subsequent process temperatures.

Figure 5C:
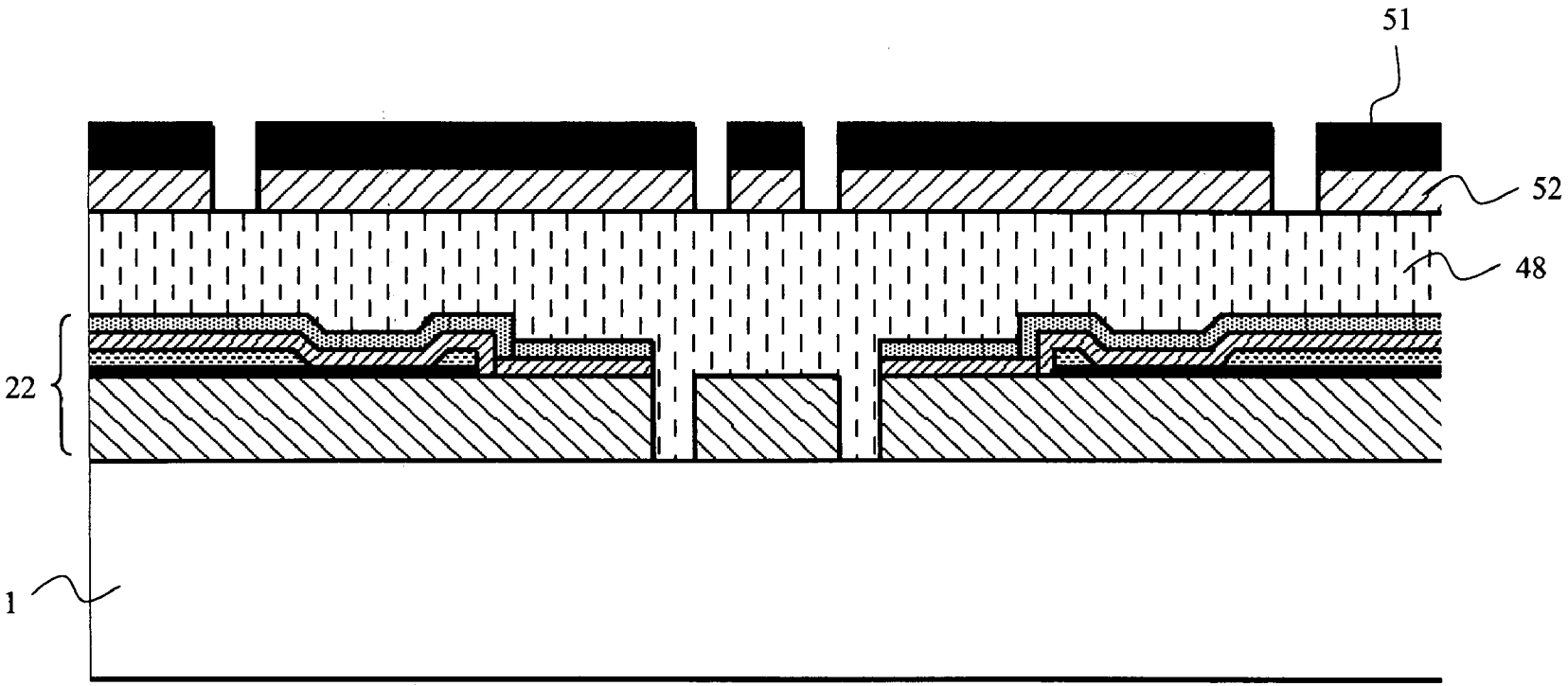

FIG. 5C shows a hard mask 52 deposited on the organic material 48. Hard mask 52 is silicon nitride, silicon oxide deposited by PECVD or aluminum deposited by sputtering. In the preferred embodiment the hard mask 52 is silicon nitride. A hard mask defining resist layer 51 is coated and patterned. The pattern is transferred to the hard mask 52 by dry etching using a fluorine-based plasma etch for nitride for example.

Figure 5D:
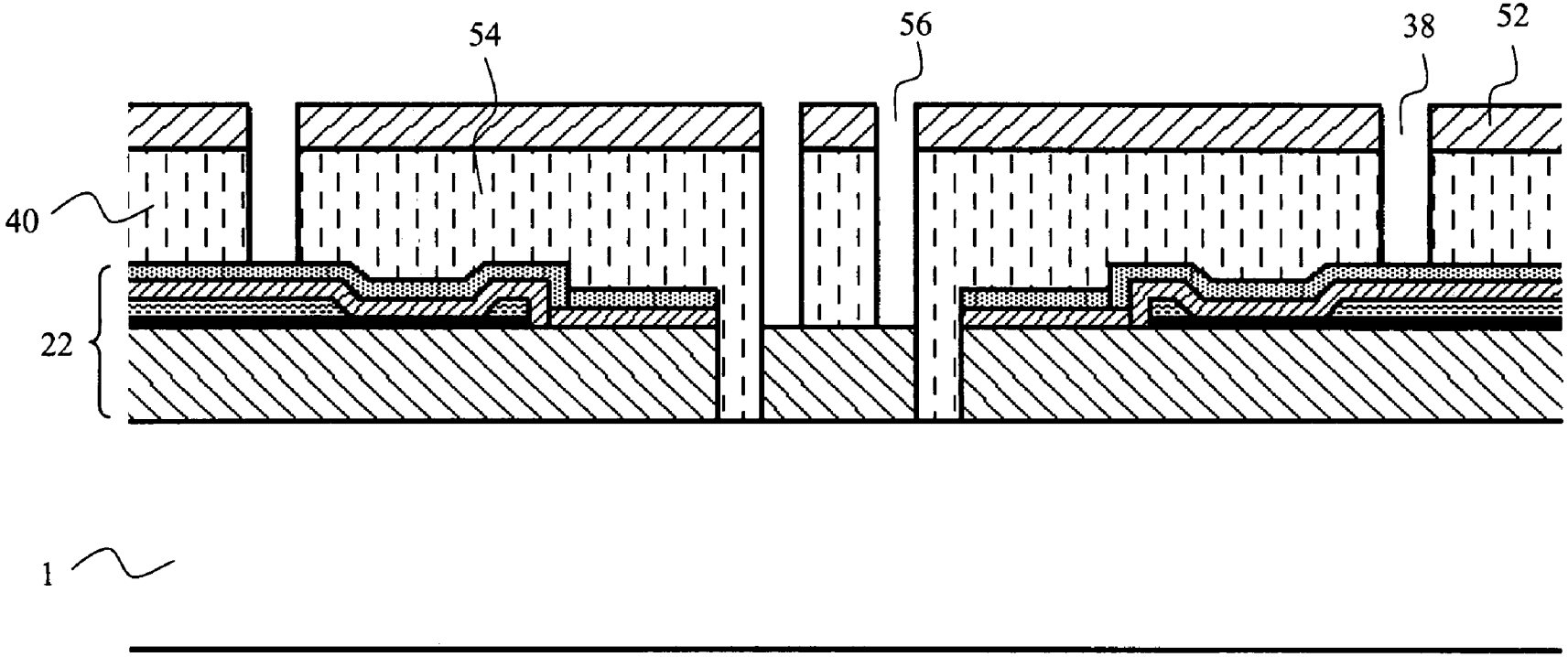

As shown in FIG. 5D the pattern of the hard mask 52 is then transferred into the organic material 48 using a low pressure, high density plasma such as an inductively-coupled plasma etch with oxygen as the main gas component. During this etch the hard mask defining resist layer 51 is removed. The transferred pattern will form openings for the chamber walls 38, filter pillars 46 (not shown), and center support region walls 56. The widths of each of these features can be different. In one embodiment the chamber walls are 8-10 μm wide. The high ion density low pressure plasma etch produces a high etch rate with very vertical etched profiles exhibiting minimal undercut so that precise chamber geometries can be made. The hard mask 52 is then removed using a dry or wet etch (step not shown in figure). The organic material 48 is divided into three regions: a polyimide passivation region 40 that protects the circuitry on the substrate and provides structural support for the nozzle plate in regions away from the chamber; a polyimide center feed support 41 that provides structural support for the nozzle plate over the ink feed; and the sacrificial polyimide region 54 that defines the region where ink will be located in the printhead.

Figure 5E:
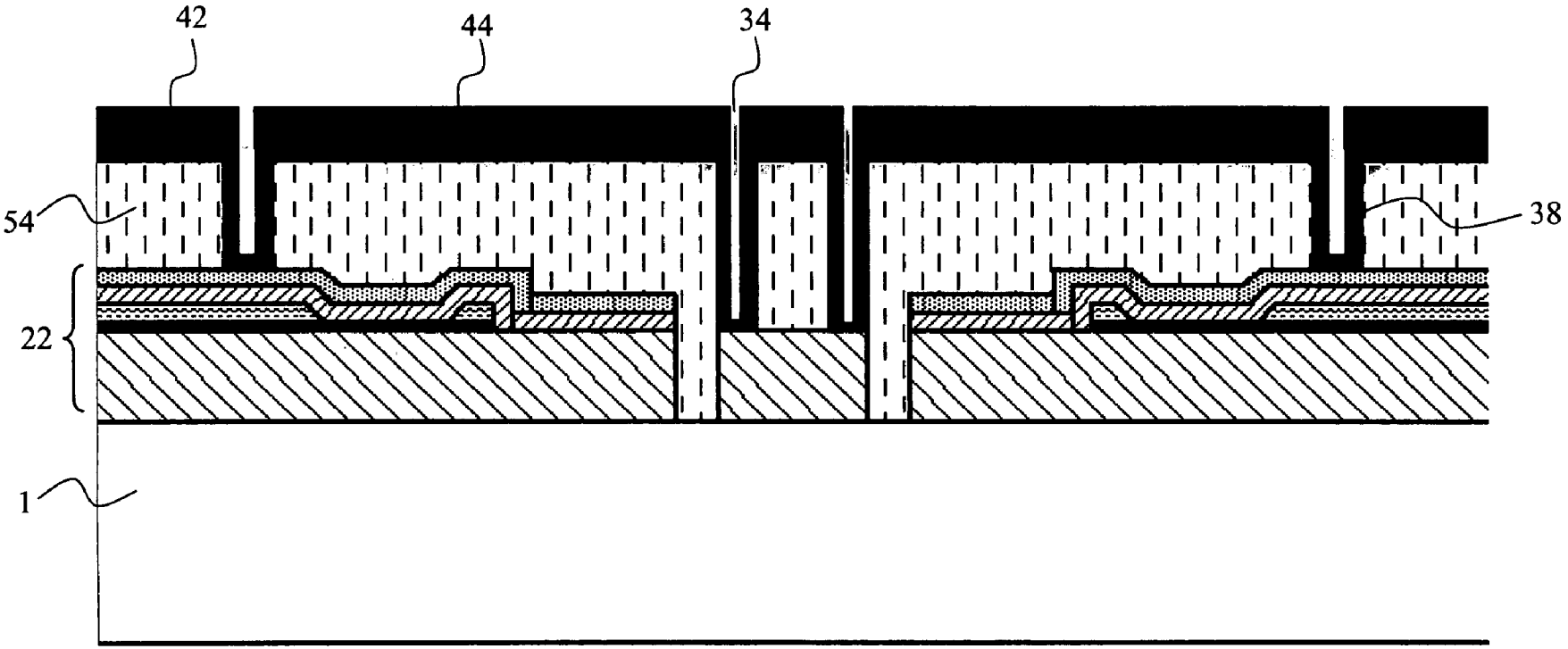

In FIG. 5E an inorganic material layer is deposited forming an inorganic chamber 34 and top liner layer 42. The inorganic material layer is silicon nitride, silicon carbide or silicon oxide. In a preferred embodiment silicon oxide is deposited at 300-400 C using Plasma enhanced chemical vapor deposition (PECVD). The use of a sacrificial polyimide layer 54 allows this high temperature deposition that is not possible in the prior art where resist is used as the sacrificial layer. This results in a denser higher quality material being deposited that will be more ink resistant and possesses better adhesion properties. A short sputter etch prior to deposition can also be done to further improve adhesion. A silicon oxide inorganic chamber 34 imparts a hydrophilic chamber providing easier ink filling and less likelihood of air bubble formation than a polymer chamber of the prior art that is more hydrophobic. The inorganic material thickness defining the top liner layer 42 and nozzle plate 44 of the inorganic chamber 34 is between 3 μm-10 μm and more preferably 7-8 μm. In one embodiment the thickness of the nozzle plate is less than the thickness of the organic material 48. Typically this deposition technique gives 50-60% sidewall coverage, which depends on the chamber wall opening, for the chamber walls 38 in the present embodiment.

Figure 5F:
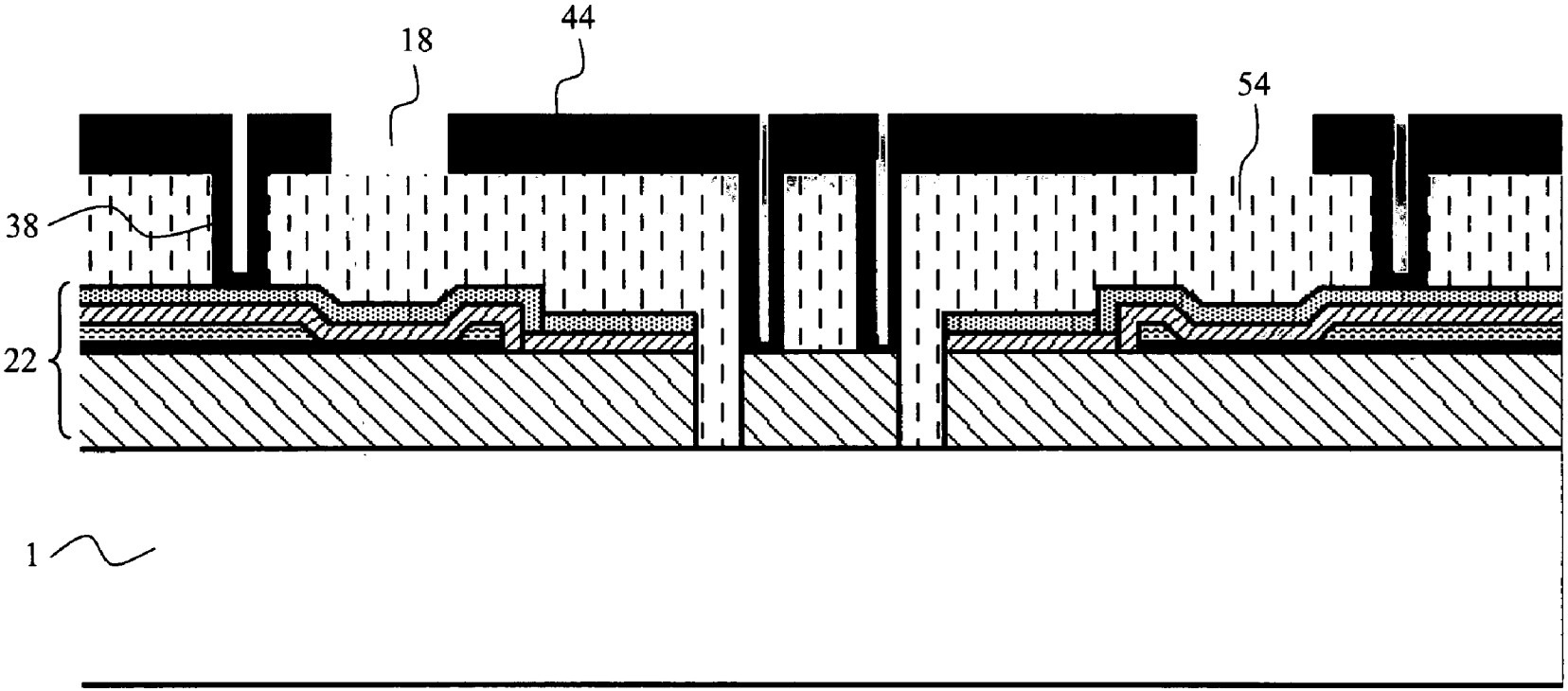

FIG. 5F illustrates nozzles 18 formed in the nozzle plate 44 by photoresist patterning and dry etching using fluorine based plasma. The etch process produces nozzles with sidewall angle>84 degrees in a 7 μm inorganic layer. During this etch the inorganic liner layer over the bond pads is removed to open up the bond pads 19.

Figure 5G:
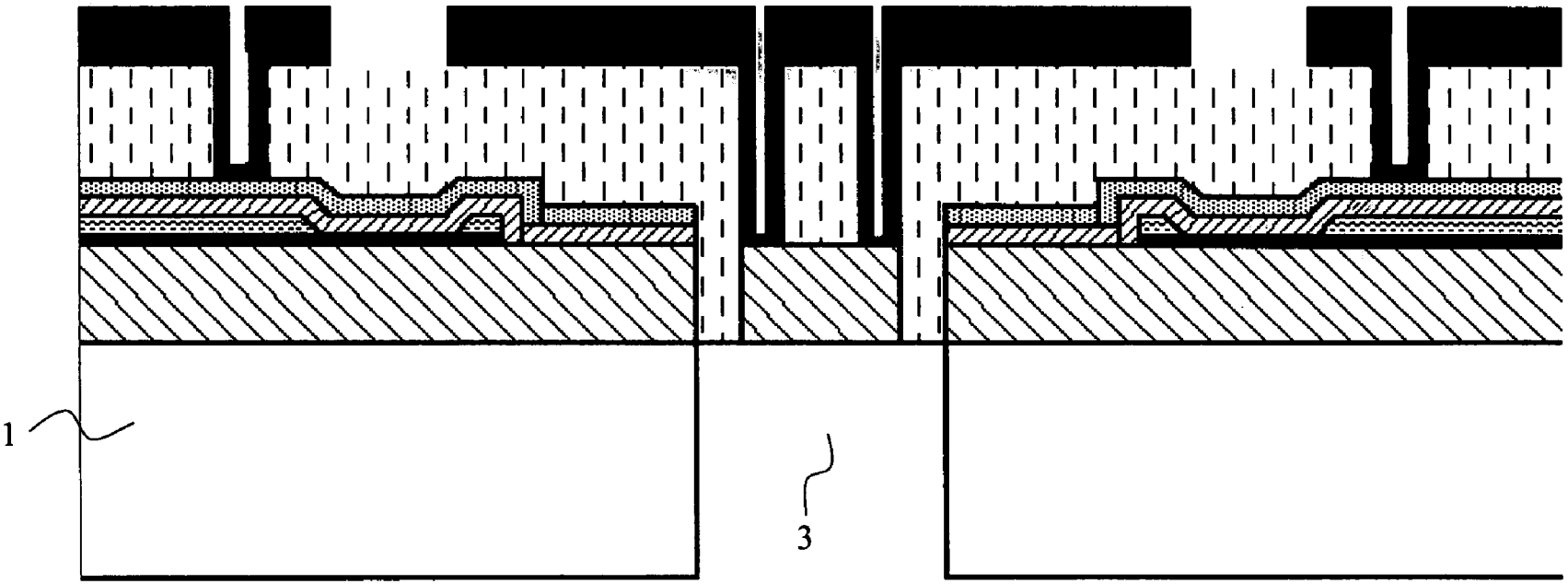

The substrate 1 is optionally thinned to a thickness of 300-400 μm and patterned on the backside with resist. In FIG. 5G the pattern is etched through the silicon substrate 1 using deep reactive ion etching with the Bosch process, as is well known in the art, to form the ink feed 3 to define a liquid supply in the substrate 1.

Figure 5H:
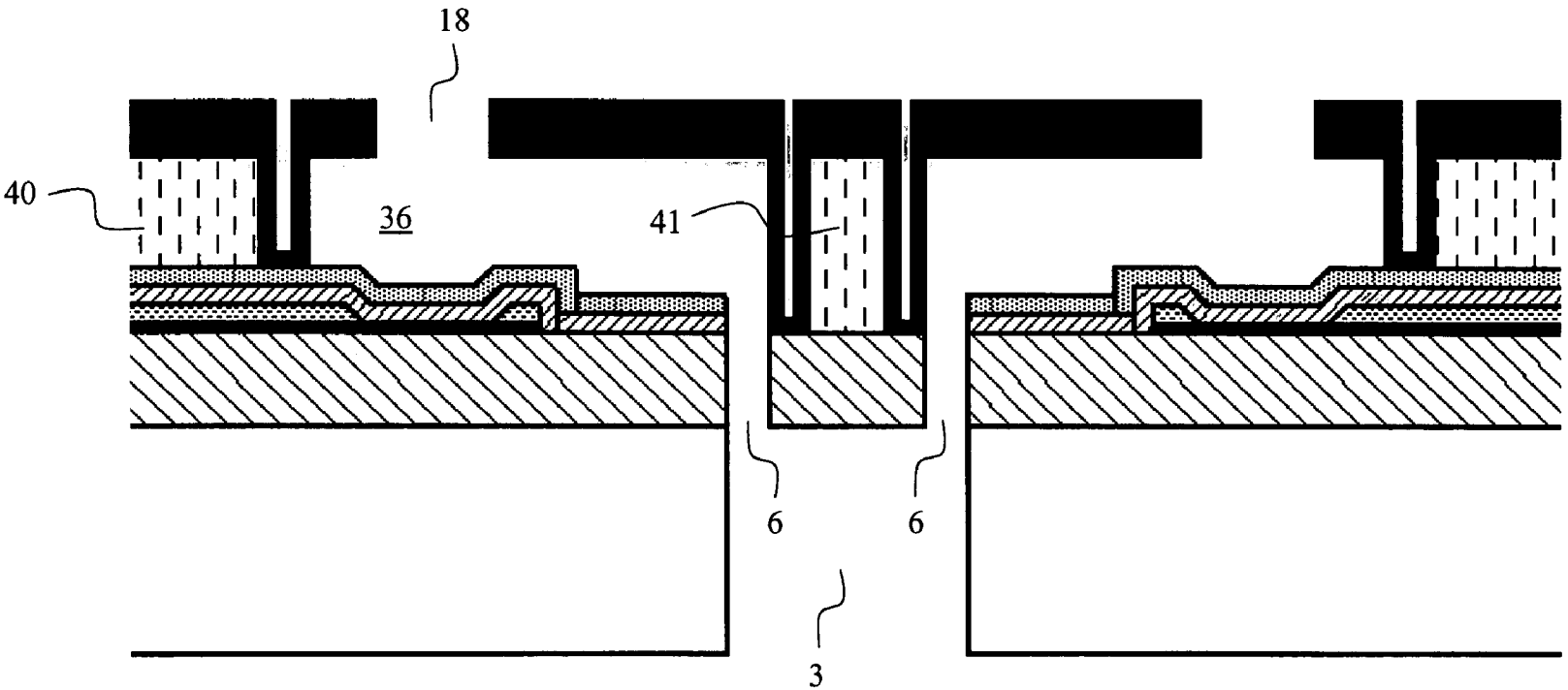

As illustrated in FIG. 5H the sacrificial polyimide region is removed through the back of the substrate and nozzles using a high pressure oxygen plasma. The removal of the sacrificial polyimide layer results in formation of the inorganic ink chamber 36 and the ink feed ports 6. The polyimide passivation 40 remains on the wafer to protect the circuitry. Polyimide center feed support 41 also remains. Both passivation 40 and center feed support 41 are bounded by chamber walls, so that they are not contactable by liquid when liquid is present in the chamber 36.

Figure 6:
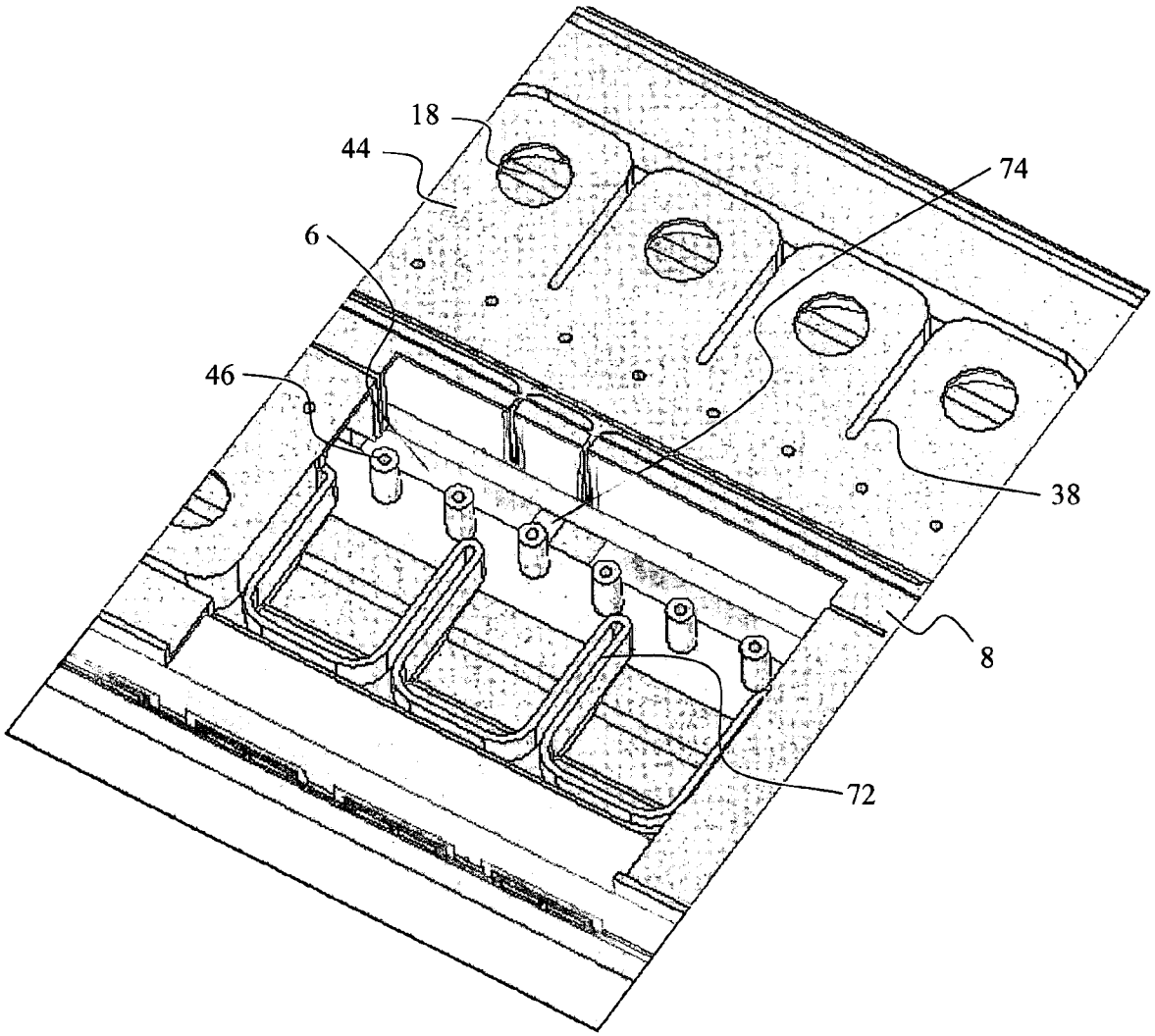
FIG. 6 illustrates a cut-away view of a section of the printhead according to the present invention.

FIG. 6 illustrates a cut-away view of the printhead with a portion of the nozzle plate removed. An inorganic material layer forms the chamber walls 38. As shown, each of the chamber walls contains a gap 72. We have discovered that it is important to maintain this gap when forming the chamber walls 38. If the deposition of the inorganic material layer continues to a point where the gap is connected, typically at the top, the added stress of this connection causes cracks in the inorganic material layer. In order to form this gap the opening for the chamber wall prior to deposition of the inorganic layer is designed greater than or equal to the thickness of the nozzle plate 44. Thus the combined width of the two wall portions and the gap is greater than the nozzle plate thickness. The chamber walls between each liquid chamber contains no organic material in order to minimize the spacing between chambers.

The inorganic material layer also forms pillars 46. In this embodiment they extend and are attached to the substrate 1 through the protection and insulating passivation layers. In other embodiments the filter pillars 46 can be suspended from the top nozzle plate 44.

FIG. 6 also shows a partial cutout of the center support region 8. The center support region contains a region of organic material positioned over the substrate that is not contactable with the ink when ink is present in the printhead. In one embodiment the center support region consists of polyimide bounded by inorganic center support region walls suspended over the liquid supply ink feed 3. On each side of the center support region are ink feed ports 6 that are above the ink feed 3 supplying ink to the two rows of nozzles 18 an opposite sides of the liquid ink feed supply.

In FIG. 6 a rib 74 formed in the substrate 1 located in the ink feed 3 and connected to the center support region is also shown. There are multiple ribs along the ink feed. These ribs provide mechanical strength to the printhead.

Figure 7:
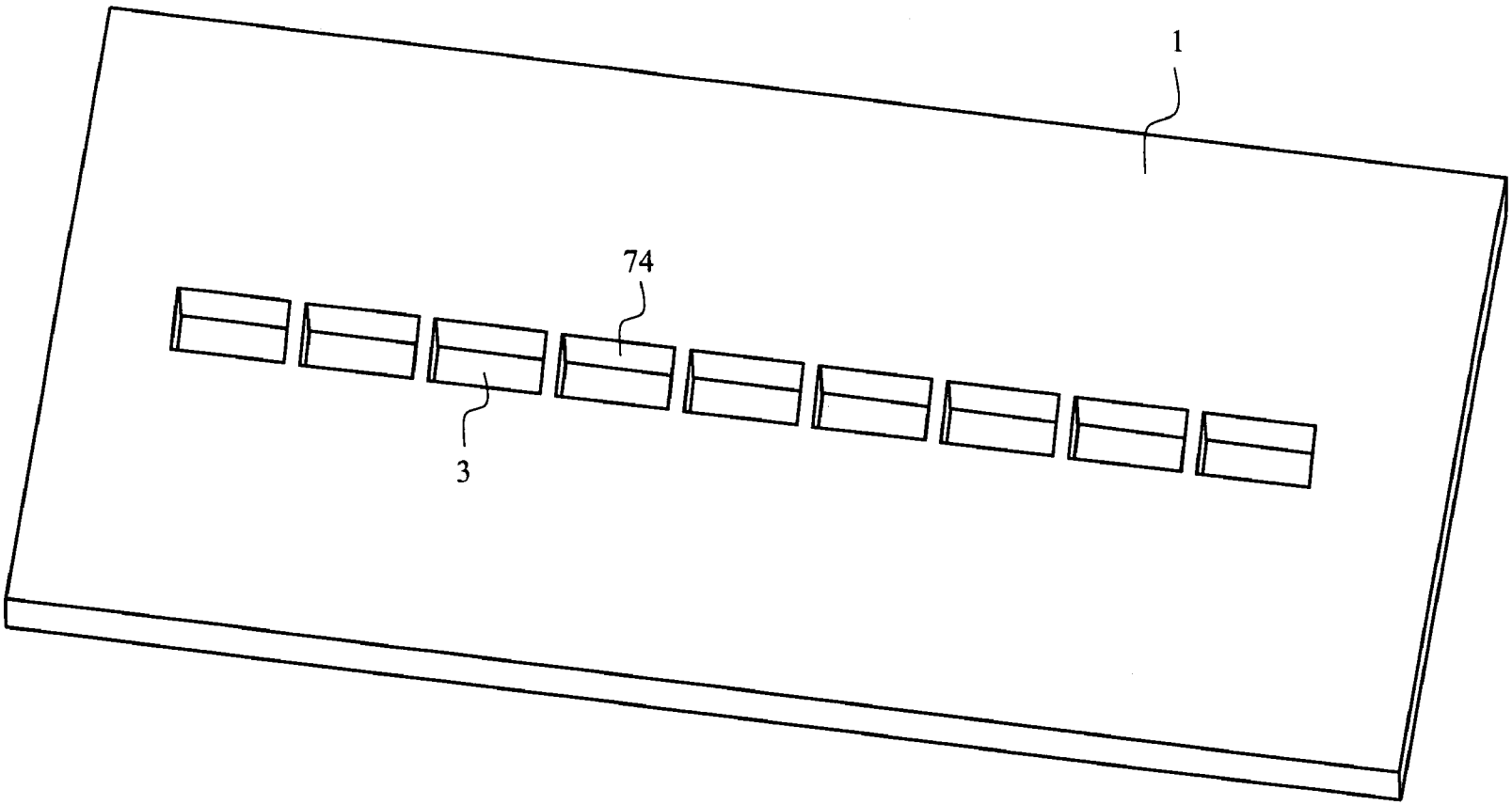
FIG. 7 illustrates the substrate 1 with an array of ribs according to the present invention.

FIG. 7 illustrates the substrate 1 alone with an array of ribs 74 in the ink feed 3. The long ink feed 3 in the substrate 1 decreases the mechanical strength of the substrate making it more susceptible to damage from torsional bending. The addition of ribs 74 across the ink feed greatly reduces this weakness. Adequate strength is achieved using multiple ribs with spacing less than 1.5 mm. This mechanical strength improvement becomes increasingly important as the length of the printhead increases. Use of ribs permits extensibility of the printhead to large arrays of nozzles.

The presence of ribs along the ink feed ports can cause printing artifacts due to the lower feed capability of ink chambers located adjacent to the ribs. We have found that for ribs less than 40 μm in width there are no such artifacts. Alternatively for strength purposes and aspect ratio for etching the ribs we have found that the rib width should be greater than 10 μm and should be connected to the center support region. In a preferred embodiment the rib width is 15-25 μm. These widths are measured at the back side of the substrate. Since the etch through the substrate is not completely anisotropic, the width of the rib at the center support region will be less than this value.

Referring back to FIG. 6 the center support region 8 is in contact with the rib and in addition has a partition support structure 57 over the rib. We have found that if this is not added the bottom layer of the center support region 8 can crack. If this occurs the polyimide of the center support region can be attacked during the sacrificial polyimide release step. The addition of this partition support structure 57 in the center support region pattern adds a stress relief that removes this tendency.

Outside of the chamber over the rest of the device area is a thick polyimide passivation layer 40, and top liner layer 42. The deposited inorganic layer 34 forms both the nozzle plate 44 and the top liner layer 42. The combination of passivation layer 40 and top liner layer 42 protects the device circuitry on the ink jet printhead 20 from degrading due to environmental effects and contact with the ink.

Figure 8:
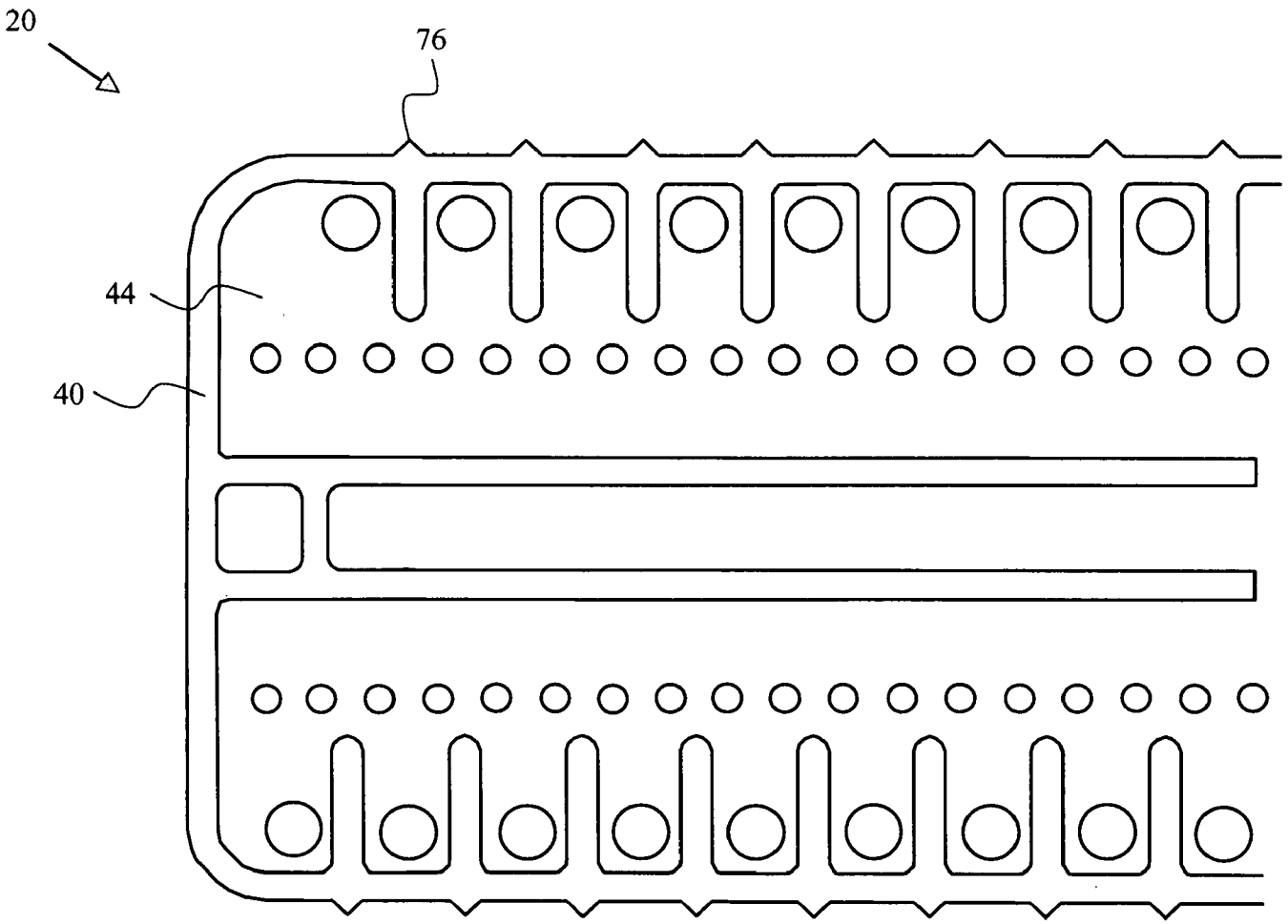
FIG. 8 illustrates one end of the ink chamber region of the printhead according to the present invention.

FIG. 8 illustrates one end of the ink chamber region of the printhead 20. In one embodiment the chamber wall adjacent to the polyimide passivation region 40 contains projections 76 extending toward the polyimide passivation region 40.

These projections act as stress relief for the chamber wall. We have found that these projections with a radius of curvature greater than 5 μm decrease the possibility of cracking of the nozzle plate 44 while projections with a radius of curvature less than 5 μm increase the possibility of cracking.

In a particular embodiment, the inorganic layer 34 defines an ink chamber 36 where ink is heated by the corresponding electrothermal element 2 and defines a nozzle 18 through which the heated ink is ejected forming an ink drop 50. The operation of the device is as follows. An electrical pulse is applied to an electrothermal heater 2. The heat pulse causes nucleation of a bubble in the chamber that grows, expelling ink from the ink chamber 36 through the nozzle 18 in the form of a drop, and also pushing ink back toward the ink feed port emptying most of the ink chamber of ink. The ejection frequency of the device is limited by the time it takes to refill the ink chamber 36. A hydrophobic chamber wall will increase the refill time causing incomplete refill of the chamber before the next firing pulse. This in turn results in ejection of a smaller and misdirected drop or in the worst case, no drop. A hydrophobic chamber wall also has a larger tendency to trap bubbles during refill. Bubbles trapped in the chamber of ink feed port again degrade the drop ejection. Organic materials used in the prior art are more hydrophobic than the inorganic liner layer of the present invention. The present invention gives the freedom to adjust the chamber to be hydrophilic by the use of inorganic materials that have a higher surface energy for water-based inks.

We have also found that the high temperature, plasma deposited silicon nitride and silicon oxide forming the chamber walls 38 have better adhesion to the protection and passivation layers on the substrate than epoxy based materials. Thus the device is more robust for long term resistance to delamination.

From the foregoing, it will be seen that this invention is one well adapted to obtain all of the ends and objects. The foregoing description of preferred embodiments of the invention has been presented for purposes of illustration and description. It is not intended to be exhaustive or to limit the invention to the precise form disclosed. Modification and variations are possible and will be recognized by one skilled in the art in light of the above teachings. For example, the present invention is not limited to chamber formation of thermal bubble jet devices but also includes chamber formation for other drop ejection methods such as thermal or electrostatic actuator or piezoelectric activated liquid devices. Such additional embodiments fall within the scope of the appended claims.

PARTS LIST

1 Substrate
2 Electrothermal heater
3 Ink feed
4 Chamber
5 Photopatternable resin
6 Ink feed ports
8 Center support region
10 Ink jet printing system
12 Image data source
14 Controller
16 Pulse source
18 Nozzle
19 Bondpads
20 Inkjet printhead
22 Thin film stack
24 Thermal barrier layer
26 Resistive Heater layer
28 Electrically conductive layer
30 Insulating passivation layer
32 Protection layer
34 Inorganic chamber
36 Chamber
38 Chamber sidewalls
40 Polyimide passivation
41 Polyimide center feed support
42 Top liner layer
44 Nozzle plate
46 Pillars
48 Organic material
50 Ink drop
51 Hard mask defining resist layer
52 Hard mask
54 Sacrificial polyimide region
56 Center support region walls
57 Partition support structure
72 Gap
74 Rib
76 Projections
90 Ink reservoir
100 Recording medium

The invention claimed is:

1. A liquid drop ejector comprising:

a substrate, portions of the substrate defining a liquid supply;

a plurality of liquid chambers, each liquid chamber being positioned over the substrate and including a nozzle plate and a chamber wall, the nozzle plate and the chamber wall including an inorganic material, the inorganic material of the nozzle plate and the chamber wall being contactable with liquid when liquid is present in each liquid chamber; and a region of organic material positioned over the substrate and located relative to the nozzle plate and the chamber wall such that the region of organic material is not contactable with liquid when liquid is present in each liquid chamber, wherein the region of organic material is bounded by chamber walls of neighboring liquid chambers located on opposite sides of the liquid supply.

2. The liquid ejector according to claim 1, wherein the region of organic material is a polyimide.

3. The liquid ejector according to claim 1, the nozzle plate including a thickness and the region of organic material including a thickness, wherein the thickness of the nozzle plate is less than the thickness of the region of organic material.

4. The liquid ejector according to claim 3, wherein the thickness of the nozzle plate is between 3 to 10 microns and the thickness of the region of organic material is between 8 to 16 microns.

5. The liquid ejector according to claim 1, wherein the inorganic material of the nozzle plate and the inorganic material of the chamber wall are the same inorganic material.

6. The liquid ejector according to claim 5, wherein the inorganic material is silicon oxide.

7. The liquid ejector according to claim 1, the nozzle plate including a top surface, the chamber wall including two wall portions of inorganic material spaced apart from each other such that a gap exists between the two wall portions, the gap extending to the top surface of the nozzle plate.

8. The liquid ejector according to claim 1, wherein no region of organic material is present between adjacent liquid chambers located on the same side of the liquid supply.

9. The liquid ejector according to claim 1, wherein at least one of the regions of organic material that is bounded by chamber walls of neighboring liquid chambers is suspended over the liquid supply.

10. The liquid ejector according to claim 1, wherein the liquid supply includes a plurality of liquid feeds with adjacent liquid feeds being separated by a rib, the rib being a portion of the substrate.

11. The liquid ejector according to claim 10, wherein at least one of the regions of organic material that is bounded by chamber walls of neighboring liquid chambers contacts the rib.

12. The liquid ejector according to claim 10, the rib having a width that is less than 40 microns.

13. A liquid drop ejector comprising:

a substrate, portions of the substrate defining a liquid supply;

a plurality of liquid chambers, each liquid chamber being positioned over the substrate and including a nozzle plate and a chamber wall, the nozzle plate and the chamber wall including an inorganic material, the inorganic material of the nozzle plate and the chamber wall being contactable with liquid when liquid is present in each liquid chamber; and a region of organic material positioned over the substrate and located relative to the nozzle plate and the chamber wall such that the region of organic material is not contactable with liquid when liquid is present in each liquid chamber, wherein no region of organic material is present between adjacent liquid chambers located on the same side of the liquid supply.

14. The liquid ejector according to claim 13, at least one of the plurality of liquid chambers including a plurality of chamber walls, wherein one of the plurality chamber walls includes a projection extending toward the organic material.

15. The liquid ejector according to claim 14, wherein the projection has a radius of curvature greater than 5 microns.

16. The liquid ejector according to claim 13, at least one of the plurality of liquid chambers including a plurality of chamber walls, wherein one chamber wall intersects another chamber wall at a corner having a radius of curvature greater than 5 microns.

17. The liquid ejector according to claim 13, each liquid chamber including an inorganic material layer located over the substrate between the substrate and the nozzle plate, the inorganic material layer being contactable with liquid when liquid is present in each liquid chamber, wherein the inorganic material layer contacts a portion of the inorganic material of the chamber wall of each liquid chamber.

18. The liquid ejector according to claim 13, the nozzle plate including a thickness and the region of organic material including a thickness, wherein the thickness of the nozzle plate is less than the thickness of the region of organic material.

19. The liquid ejector according to claim 13, the nozzle plate including a top surface, the chamber wall including two wall portions of inorganic material spaced apart from each other such that a gap exists between the two wall portions, the gap extending to the top surface of the nozzle plate.

20. A liquid drop ejector comprising:

a substrate;

a liquid chamber for receiving a liquid, the liquid chamber being positioned over the substrate and including a nozzle plate and a chamber wall, the nozzle plate and the chamber wall including an inorganic material, the inorganic material of the nozzle plate and the chamber wall being contactable with the liquid when the liquid is present in the chamber, the nozzle plate including a top surface, the chamber wall including two wall portions of inorganic material spaced apart from each other such that a gap exists between the two wall portions, the gap extending to the top surface of the nozzle plate; and a region of organic material positioned over the substrate and located relative to the nozzle plate and the chamber wall such that the region of organic material is not contactable with the liquid when the liquid is present in the chamber.

21. The liquid ejector according to claim 20, the two wall portions and the gap having a combined width, the nozzle plate having a thickness, wherein the combined width of the two wall portions and the gap is greater than the nozzle plate thickness.

* * * * *